US008191436B2

(12) United States Patent
Chun et al.

(10) Patent No.: US 8,191,436 B2
(45) Date of Patent: Jun. 5, 2012

(54) APPARATUS FOR COLLECTING MARINE DEPOSITS

(75) Inventors: Jong Hwa Chun, Daejeon (KR); Byong Jae Ryu, Daejeon (KR); Jin Ho Kim, Daejeon (KR); Jang Jun Bahk, Daejeon (KR); Young Sang Eo, Siheung-si (KR)

(73) Assignee: Korea Institute of Geoscience and Mineral Resouces (KIGAM), Daejeon (KR)

( * ) Notice: Subject to any disclaimer, the term of this patent is extended or adjusted under 35 U.S.C. 154(b) by 0 days.

(21) Appl. No.: 12/976,938

(22) Filed: Dec. 22, 2010

(65) Prior Publication Data

US 2011/0232138 A1 Sep. 29, 2011

(30) Foreign Application Priority Data

Mar. 25, 2010 (KR) ..... 10-2010-0026727

(51) Int. Cl.
*G01N 1/08* (2006.01)

(52) U.S. Cl. ..... 73/864.44

(58) Field of Classification Search ..... 73/864.44, 73/864.41, 864.42
See application file for complete search history.

(56) References Cited

FOREIGN PATENT DOCUMENTS

| | | | |
|---|---|---|---|
| JP | 08-178915 | A | 7/1996 |
| JP | 2004-068355 | A | 3/2004 |
| JP | 2005-155108 | A | 6/2005 |
| KR | 10-2001-0023192 | A | 3/2001 |
| KR | 10-0727590 | B1 | 6/2007 |

*Primary Examiner* — Hezron E Williams
*Assistant Examiner* — Paul West
(74) *Attorney, Agent, or Firm* — The Webb Law Firm

(57) ABSTRACT

Provided is an apparatus for collecting marine deposits. The apparatus includes: a piston corer for collecting a deep part of marine deposits; a corer for collecting a surface part of marine deposits; and a trigger body connecting the corer for collecting a surface part of marine deposits and the piston corer for collecting a deep part of marine deposits to each other while being maintained at a laterally set interval. The apparatus for collecting marine deposits can greatly save costs consumed to collect marine deposits and increase accuracy of collecting the marine deposits.

7 Claims, 5 Drawing Sheets

APPARATUS FOR COLLECTING MARINE DEPOSITS

TECHNICAL FIELD

The present invention relates to an apparatus for collecting marine deposits by introducing the apparatus through a cable from a ship on the sea.

BACKGROUND ART

Since marine deposits well preserve information on the environmental change on Earth, they are used as data for paleoenvironmental research and include mineral resources at sea (gas, gas hydrate, manganese nodule, phosphate rock, marine sand, or the like), such that they have been in the limelight as an energy source.

Further, the marine deposits have been used as research data for marine pollution or pollutants originated from a land.

As described above, since the marine deposits can be used as various purposes, there is a need to collect marine deposits. To this end, various types of apparatuses for collecting marine deposits have been proposed.

As these apparatuses for collecting marine deposits, there are a grab, a dredge, a piston corer, a gravity corer, a multi corer (see Korean Patent Application No. 10-20005-0132098, or the like), or the like.

The grab is mainly used at the coast, which is used for dredging polluted marine deposits and the dredge for maintaining waterways. However, the grab has a problem in entirely disturbing the collected deposits (mixing or distorting the marine deposits, not keeping the depositional structures).

Further, the dredge is a method for collecting marine deposits while a ship is moving. The dredge is mainly used for collecting rocks such as manganese nodule and solidified phosphate rock included in the marine deposits.

Since the dredge entirely disturbs the marine deposits collected and should move over the wide area, there is a problem in that it cannot accurately know a sample collecting position.

The piston corer apparatus has a structure having a piston corer in which a piston body composed of a plastic material serving as a piston is inserted into an external body serving as a cylinder body. In detail, the piston corer has a structure in which the piston corer instantly falls free while the wound cable is untied when a trigger weight installed at the side bottom portion of the piston corer and serving as a weight first reaches the seafloor and is stuck in a deep part of the sea bottom, thereby collecting the marine deposits.

That is, when the trigger weight does not reach the seafloor, the piston corer slowly falls along the trigger weight from the side top point of the trigger weight, but when the trigger weight reaches the seafloor, the piston corer rapidly falls while a rope connected and wound on the piston corer is untied, such that it is struck in the deep part of the sea bottom.

When the piston corer is stuck in the sea bottom, since the piston body moves to the upper portion of the external body, the marine deposits are smoothly filled in the external body.

When the piston corer is stuck in the sea bottom, a considerable impact is applied to the seafloor. As a result, a method of using the piston corer disturbs the surface part of the marine deposits but is deeply stuck in the sea bottom (up to the deep part) and does not disturb marine deposits at a deep part of the sea bottom, thereby making it possible to effectively and stably secure the marine deposits at the deep part.

A length of the piston corer is manufactured in consideration of a length of a ship or a height of a winch. Generally, the piston corer is manufactured to have a length of about 3 m to 15 m.

The gravity corer apparatus has a structure having a gravity corer in which a plastic pipe serving as a piston is inserted into an iron pipe serving as a cylinder body. The gravity corer apparatus is stuck in the sea bottom by its own weight and a free fall force, thereby collecting the marine deposits.

When the gravity corer reaches the seafloor, a considerable impact is applied to the sea bottom, such that a disturbance phenomenon occurs at the top portion of the marine deposits.

The length of the gravity corer is similar to that of the piston corer; however, the weight of the gravity corer is much heavier than that of the piston corer.

The box corer apparatus has a structure having a box corer composed of a metal material having a collecting body positioned at the middle thereof, while the top and bottom portions thereof are not closed. When the frame reaches the seafloor, the collecting body moves towards the marine deposits, the lower stopper having the shovel shape descends, thereby collecting the marine deposits.

The box corer can collect the marine deposits at a depth of about 1 m without disturbing the surface part of marine deposits.

However, the box corer has a problem in that it is difficult to attach and detach the collection body and it takes a long time to attach and detach the collecting body.

The multi corer apparatus has a structure in which approximately 6 to 8 collecting bodies having a pipe shape and composed of a plastic material are installed in a frame. When the frame of the multi corer reaches the seafloor, it is triggered to move the collecting body towards the marine deposits, thereby collecting the marine deposits.

The multi corer can collect the marine deposits at about 50 cm from the seafloor without causing the disturbance of the marine deposits at the upper portion of the seafloor.

The multi corer needs less time to attach and detach the collecting body as compared to the box corer, but has a disadvantage in that the volume of the apparatus is large.

Meanwhile, a method for collecting marine deposits is optionally selected depending on the purpose. In some cases, several methods may be used together at the same position.

The collecting time of the marine deposits depends on the depth of water of an area to be probed. In the case of the deep sea, the collecting time can take as long as several hours to collect the marine deposits.

The piston corer or the gravity corer is used to collect the marine deposits for research of paleoenvironment or mineral resources at the sea. The primary purpose thereof is to obtain the marine deposits at a possible deep part within the range where the conditions of the ship is permitted.

Further, since the deposits at a depth of 50 cm from the sea bottom are data through which a recent deposited environment can be appreciated, the multi corer or the box corer has been used to collect the marine deposits in the state in which the marine deposits are not disturbed.

There are cases in which the marine deposits at the surface part of the seafloor are collected in the same position and the marine deposits at the deep part of the sea bottom are secured.

To this end, the deposits were collected up to the deep part of the sea bottom through the piston corer or the gravity corer and were collected in the state in which the marine deposits of the surface part of the sea bottom are not disturbed.

That is, the collecting work of the marine deposits was performed twice at the same position.

The working method increases costs consumed to probe the marine deposits and has low accuracy of probe.

Even though the collecting apparatus is introduced into the sea bottom from the same position on the sea, the case where each collecting apparatus is not arrived at the same sea bottom due to the influence of sea current, or the like frequently occurs, which degrades the accuracy of collecting the marine deposits.

DISCLOSURE

Technical Problem

An object of the present invention is to provide an apparatus for collecting marine deposits capable of greatly saving costs consumed to collect the marine deposits of the surface part of the sea bottom at the same position and the deposits at the deep part of the sea bottom and improving accuracy of collecting the marine deposits.

Technical Solution

The present invention introduces a corer capable of collecting marine deposits at a surface part of a sea bottom and a corer capable of collecting marine deposits at a deep part of the sea bottom, which are installed to be connected to each other, into the sea bottom at a time, wherein the corer capable of collecting the deep part of the marine deposits is implemented by the piston corer manner and the corer capable of the surface part of the marine deposits is implemented by a manner of using its own weight, thereby making it possible to greatly save costs consumed to collect the marine deposits and improve the accuracy of collecting the marine deposits.

Further, the apparatus for collecting marine deposits includes a piston corer for collecting marine deposits of a deep layer portion having an external body stuck in the deep part of a sea bottom while serving as a cylinder body and having a piston body positioned in the external body to move up and down and serving as a piston.

In addition, the apparatus for collecting marine deposits includes a corer for collecting marine deposits of a seafloor including a deposit inserting pipe in a pipe shape stuck in the surface part of the sea bottom and extending downwardly from a frame and an upper cover and a lower cover blocking the upper and lower portions of the deposits inserting pipe when the deposits inserting pipe is stuck in the sea bottom and first contacting the seafloor than a corer for collecting the deep part of the marine deposits while having a weight guiding the falling of the corer for collecting the deep part of the marine deposits Moreover, the apparatus for collecting marine deposits includes a trigger body connecting the corer for collecting a surface part of marine deposits and the corer for collecting a deep part of marine deposits to each other while being maintained at a laterally set interval and when the corer for collecting a surface part of marine deposits is safely seated at the sea bottom, the piston corer for collecting a deep part of marine deposits free falls to be stuck in the deep part of the sea bottom while a rope connected to the piston corer for a deep part of marine deposits is instantly untied.

Advantageous Effects

As set forth above, the apparatus for collecting the marine depositing layer is provided with the corer capable of collecting the marine deposits at the surface part of the sea bottom and the corer capable of collecting the marine deposits at the deep part of the sea bottom, which are connected to each other, to be introduced into the sea bottom at a time, wherein the corer capable of collecting the deep part of the marine deposits is implemented by the piston corer manner and the corer capable of surface part of the marine deposits is implemented by a manner of using its own weight.

Therefore, the present invention can greatly save costs consumed to collect the marine deposits and improve the accuracy of collecting the marine deposits.

A corer for collecting a surface part of marine deposits is further provided with the cover driving unit controlling the driving of the upper cover and the lower cover. The cover driving unit is configured so that the upper cover blocks the upper portion of the deposits inserting pipe in the state in which the upper portion of the deposits inserting pipe is filled with sea water, thereby making it possible to collect the sea water around the seafloor and use the collected sea water for research and analysis.

DESCRIPTION OF DRAWINGS

The above and other objects, features and advantages of the present invention will become apparent from the following description of preferred embodiments given in conjunction with the accompanying drawings, in which:

FIG. 3A shows a falling state;

FIG. 3B shows a state just before where a deposit inserting pipe is stuck in the sea bottom and the lower cover is dug into the sea bottom;

FIG. 3C is a diagram showing a state in which the deposit inserting pipe is stuck in the sea bottom, the lower cover blocks the lower portion of the deposit inserting pipe, and the upper cover blocks the upper portion of the deposit inserting pipe;

FIG. 3D is a diagram showing a state in which the corer for collecting a surface part of marine deposits is salvaged;

BEST MODE

Figure 1:
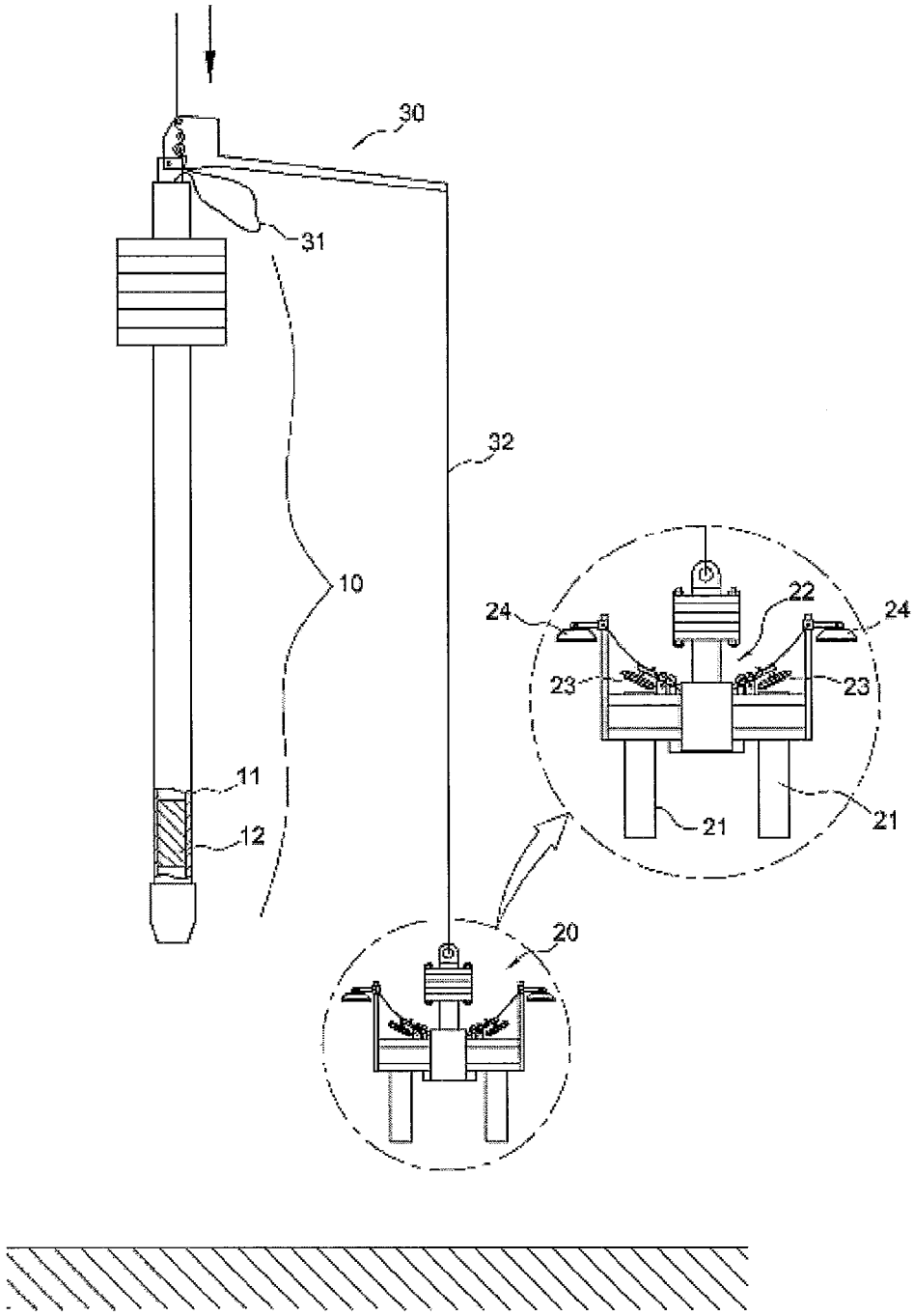
FIG. 1 is a schematic diagram showing a state in which an apparatus for collecting marine deposits of the present invention falls toward the sea bottom.
Figure 2:
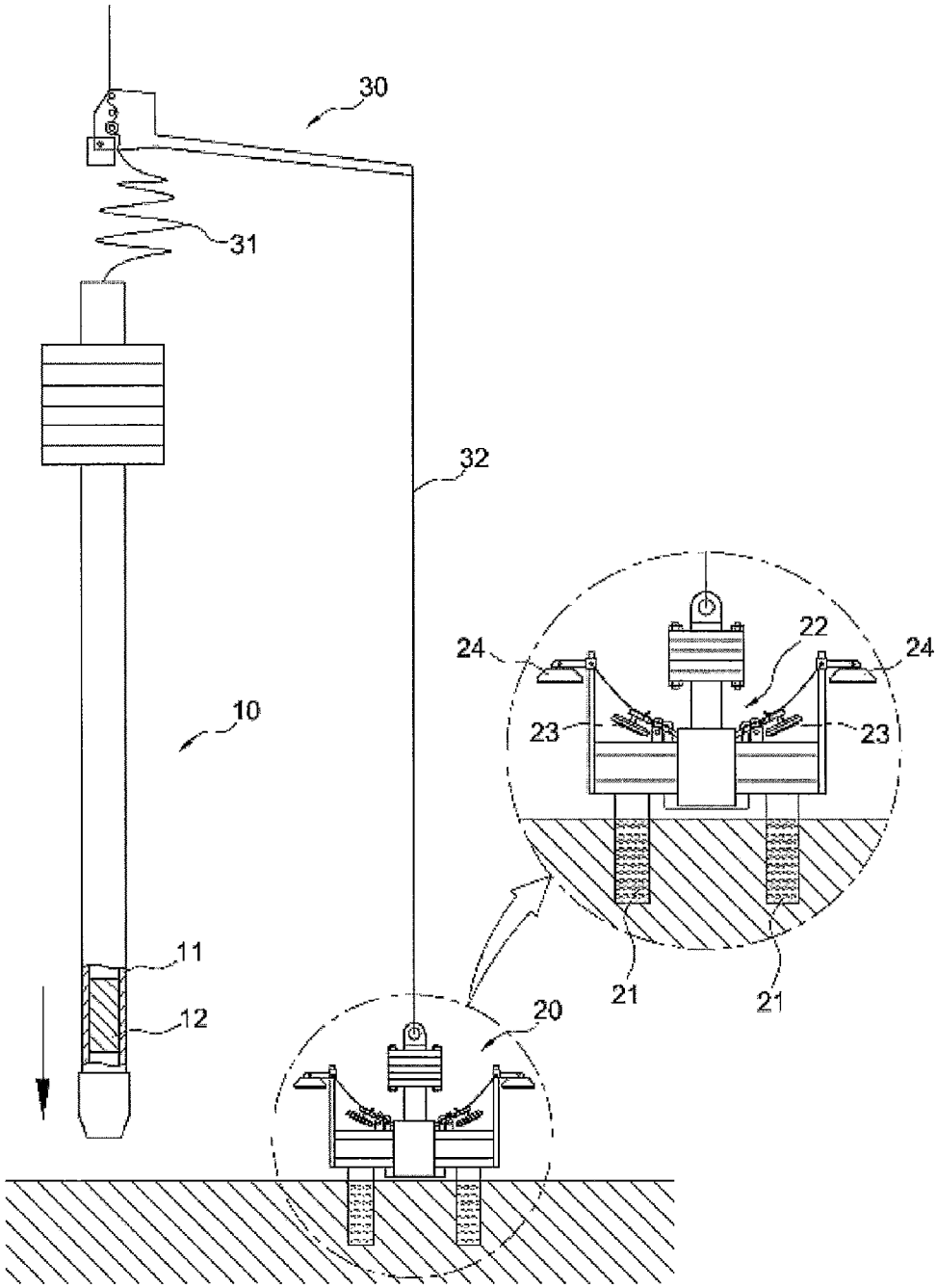
FIG. 2 is a schematic diagram showing a state in which a corer for collecting a surface part of marine deposits is safely arrived at the sea bottom and a piston corer for collecting a deep part of marine deposits falls free, in the apparatus for collecting marine deposits according to the present invention.
Figure 3:
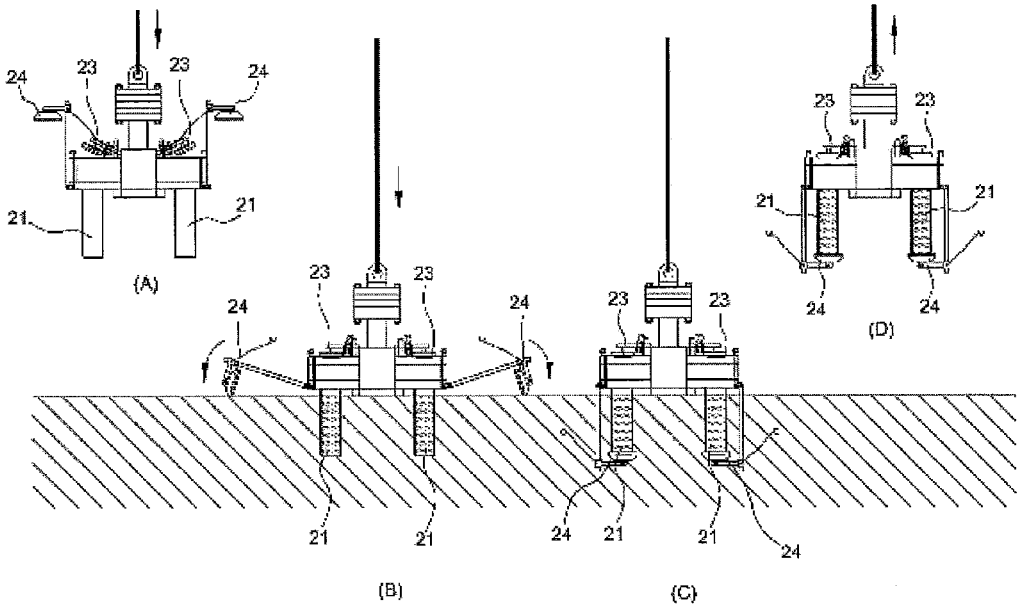
FIG. 3 is a schematic diagram for explaining a process of collecting marine deposits by allowing the corer for collecting a surface part of marine deposits, that is a component of the present invention, to safely arrive at the sea bottom.

Hereinafter, the present invention will be described in more detail with reference to the accompanying drawings.

However, the accompanying drawings is only an example shown for explaining in detail the technical ideas of the present invention and the technical ideas of the present invention are not limited to the shape of the accompanying drawings.

The present invention relates to an apparatus for collecting marine deposits. An object of the present invention is to provide the apparatus for collecting marine deposits capable of greatly saving costs consumed to collect the surface part of the sea bottom at the same position and the deposits at the deep part of the sea bottom and improving accuracy of collecting the marine deposits.

To the end, the apparatus for collecting marine deposits of the present invention is provided with a corer capable of collecting the marine deposits at the surface part of the sea bottom and a corer capable of collecting the marine deposits at the deep part of the sea bottom, which are connected to each other by a single cable, such that the apparatus for collecting marine deposits is configured to be introduced into the sea bottom at a time when it is introduced into the sea bottom.

That is, the related art performs the work of collecting the surface part of marine deposits and the work of collecting marine deposits of the deep part separately, while the present invention performs the works at a time.

However, when collecting the marine deposits at the surface part of the sea bottom, the marine deposits at the deep part of the sea bottom should be smoothly collected without causing the disturbance phenomenon.

Further, the work of falling to the sea bottom through a cable from the ship should be smoothly performed.

In particular, the work of relatively accurately seat the apparatus for collecting marine deposits according to the present invention at a place where the marine deposits are collected should be easily made.

For these reasons, in the present invention, the corer for collecting deep part of marine deposits is implemented as the piston corer form and the corer for collecting the surface part of marine deposits is implemented by a manner of using its own weight and is implemented to perform the same action as a trigger weight of the piston corer apparatus of the related art.

The apparatus for collecting marine deposits includes a piston corer 10 for collecting marine deposits of a deep part having an external body 11 stuck in the deep part of a sea bottom while serving as a cylinder body and having a piston body 12 positioned in the external body 11 to move up and down and serving as a piston.

Further, the apparatus for collecting marine deposits includes a deposit inserting pipe 21 in a pipe shape that is stuck in the surface part of the sea bottom extends downwardly from a frame 22 and a corer 20 for collecting a surface part of marine deposits first contacts the sea bottom than a corer 20 for collecting a surface part of marine deposits while having a weight guiding the falling of the piston corer 10 for collecting a deep part of marine deposits.

In addition, the apparatus for collecting marine deposits includes a trigger body 30 connecting the corer 20 for collecting a surface part of marine deposits and the piston corer 10 for collecting a deep part of marine deposits to each other while being maintained at a laterally set interval and when the corer 20 for collecting a surface part of marine deposits is safely seated at the sea bottom, free-falling the piston corer 10 for collecting a deep part of marine deposits to be stuck in the deep part of the sea bottom surface while a rope 31 connected to the piston corer 10 for collecting a deep part of marine deposits is instantly untied.

The piston corer 10 for collecting a deep part of marine deposits has the same shape as the piston corer included in the piston corer apparatus of the related art and the trigger body 30 is implemented to have the same shape as the trigger body 30 included in the piston corer apparatus, which is an already known technology. Therefore, the detailed description thereof will be omitted.

Further, the structure in which the corer 20 for collecting a surface part of marine deposits first contacts the seafloor than the piston corer 10 for collecting a deep part of marine deposits while having a weight guiding the falling of the piston corer 10 for collecting a deep part of marine deposits is already known through a trigger weight, or the like, included in the piston corer apparatus of the related art. Therefore, the detailed description thereof will also be omitted.

Since the corer 20 for collecting a surface part of marine deposits has a considerable weight in order to be performed as the trigger weight, the deposits inserting pipe 21 is dug into the surface part of the sea bottom by its own weight, such that the marine deposits at the surface part of the sea bottom are inserted into the deposits inserting pipe 21 in the state where they are not disturbed.

However, a unit for preventing the deposits inserted into the deposits inserting pipe 21 from being lost or disturbed during a process of salvaging the apparatus of the present invention is needed (in most cases, the surface part of the sea bottom is filled with about 80% of water and thus, is a very soft state, such that it is highly likely to cause the disturbance phenomenon).

To this end, the corer 20 for collecting a surface part of marine deposits has an upper cover 23 and a lower cover 24 blocking the upper portion and the lower portion of the deposits inserting pipe 21 when the deposits inserting pipe 21 is stuck in the sea bottom.

It is preferable that the deposits inserting pipe 21 of the above-mentioned corer 20 for collecting a surface part of marine deposits is provided in plural to increase the reliability of the collected marine deposits and to prepare for the disturbance phenomenon, or the like, which may be caused.

The deposits inserting pipe 21 may be made of a material such as synthetic resin, metal, etc. It is preferable that the deposits inserting pipe 21 is made by selecting an appropriate material according to the state of the surface part.

A cover driving unit 25 controlling the driving of the upper cover 23 and the lower cover 24 is provided in the corer 20 for collecting a surface part of marine deposits and the cover driving unit 25 is configured to control the opening and closing of the cover, which may be implemented in various shapes applied to various industrial fields.

However, it is preferable that the present invention is implemented so that the upper cover 23 blocks the upper portion of the deposits inserting pipe 21 in the state where the upper portion of the deposits inserting pipe 21 is filled with sea water.

According to the above configuration, the apparatus of the present invention can collect the sea water around the sea bottom to minimize an empty space within the deposits inserting pipe 21, thereby making it possible to prevent the disturbance phenomenon of the collected marine deposits.

Figure 4:
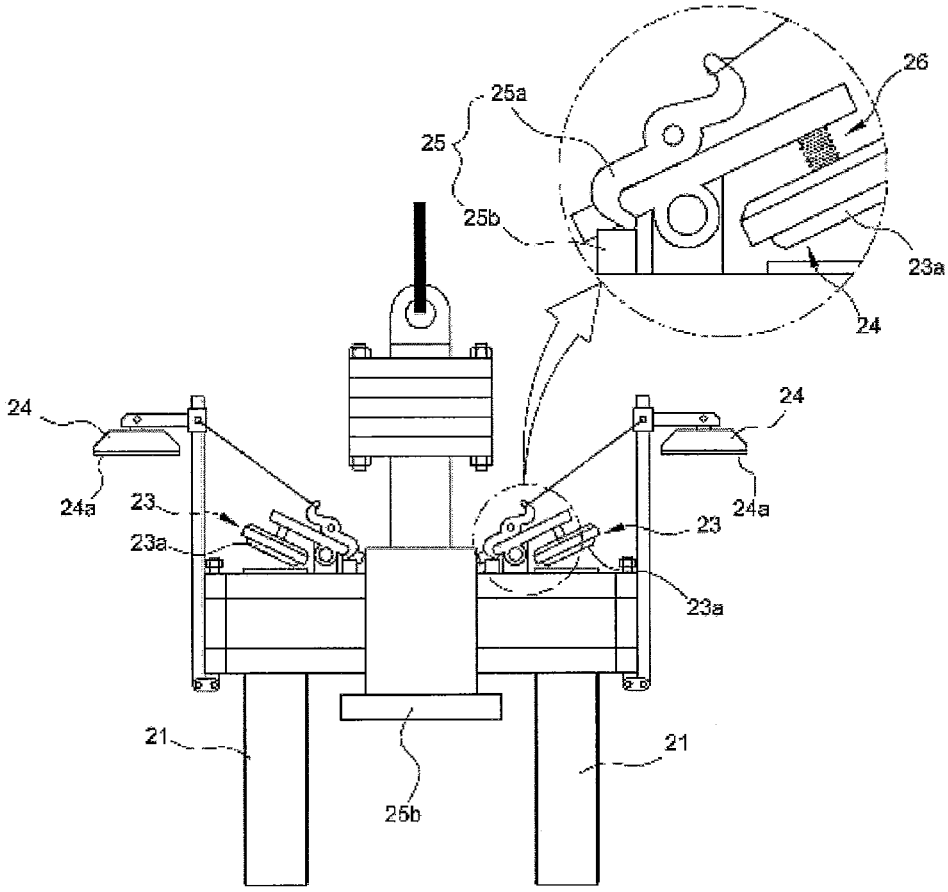
FIG. 4 is a schematic diagram for explaining a cover driving unit of the corer for collecting a surface part of marine deposits that is a component of the present invention, wherein it shows a state in which the upper cover and the lower cover do not block the deposits inserting pipe.
Figure 5:
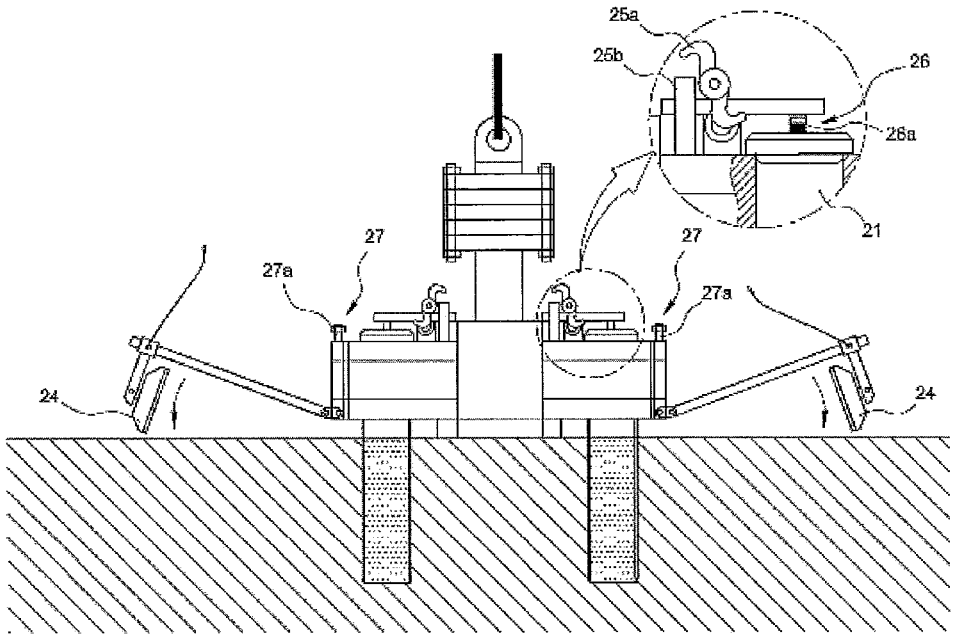
FIG. 5 is a schematic diagram showing a state in which the deposits inserting pipe is not blocked due to the movement of the upper cover and the lower cover by rotating a ring after the state of FIG. 4.

The detailed example of the cover driving unit 25 is shown in FIGS. 4 and 5.

In the case of FIGS. 4 and 5, a rotatable ring 25*a* gripping the upper cover 23 is provided so that the upper cover 23 is in the state of opening the upper portion of the deposits inserting pipe 21.

Further, an upper moving body 25*b* positioned corresponding to the central portion of the deposits inserting pipe 21 is provided in order to remove a force gripping the upper cover 23 by rotating the ring 25*a* while moving upwardly when contacting the sea bottom.

Therefore, when the marine deposits are filled up to about half of the deposits inserting pipe 21, the upper cover 23 blocks the upper portion of the deposits inserting pipe 21, which has a form of blocking the upper portion of the deposits inserting pipe 21 in the state where the upper portion of the deposits inserting pipe 21 is immediately filled with sea water.

In the accompanying drawings, the ring 25*a* also grips the lower cover 24 so that the lower portion of the deposits inserting pipe 21 is an opened state and when the ring 25*a* is rotated by the upper moving body 25*b*, it is in the state where it does not grip the lower cover 24.

Therefore, when the marine deposits are filled up to about half of the deposits inserting pipe 21, the lower cover 24 as well as the upper cover 23 moves so that both of the upper portion and the lower portion of the deposits inserting pipe 21 are blocked.

In the accompanying drawings, when the upper cover 23 and the lower cover 24 remove a force fixed by the ring 25*a*, they are rotated by the self-weight thereof to block the upper portion and the lower portion of the deposits inserting pipe 21, respectively.

As described above, since the surface part of the sea bottom is in a very soft sate, the lower cover 24 is smoothly dug into the surface part of the sea bottom by the load of the lower cover 24, thereby making it possible to block the lower portion of the deposits inserting pipe 21.

Further, when the surface part of the sea bottom is not in a soft state, an elastic body forcibly applying a force to the lower cover 24, or the like, may be further provided.

In the present invention, it is preferable that the upper cover 23 is provided with a packing 23*a*, which is installed at a portion closely attached to the deposits inserting pipe 21 so as to be blocked.

Further, it is preferable that the lower cover 24 is provided with a packing 24*a*, which is installed at a portion closely attached to the deposits inserting pipe 21 so as to be blocked.

According to the above configuration, the upper portion and the lower portion of the deposits inserting pipe 21 can be firmly blocked, which is a very important component capable of preventing the loss of the marine deposits sample when the marine deposits collected in the deposits inserting pipe 21 are in a very soft state.

When an upper cover positional controlling unit 26 is further provided to control a distance from a portion in which the upper cover 23 is fixed to the lower end portion of the upper cover 23, an initial setting work to smoothly block the upper portion of the deposits inserting pipe 21 is easily performed.

The upper cover positional controlling unit 26 may be implemented by a manner as shown in the accompanying drawings to control a distance from the portion in which the upper cover 23 is fixed to the lower end portion of the upper cover 23 by tightening or releasing a bolt 26*a*.

In the present invention, the lower cover positional controlling unit 27 may be further provided in order to control the distance from the portion in which the lower cover 24 is fixed to the lower end portion of the lower cover 24. In this case, the initial setting work to smoothly block the lower portion of the deposits inserting pipe 21 is easily performed.

The upper cover positional controlling unit 26 may be implemented by the manner, or the like, to control a distance from the portion in which the upper cover 23 is fixed to the lower end portion of the upper cover 23 by tightening or releasing the bolt 27*a*.

When the apparatus of the present invention is introduced into the sea bottom from the ship, it falls in a form where the corer 20 for collecting a surface part of marine deposits is positioned at the lower portion and the piston corer 10 for collecting a deep part of marine deposits is positioned in an upper side (see FIG. 1).

Further, when the corer 20 for collecting a surface part of marine deposits is safely seated at the sea bottom, the deposits inserting pipe 21 is inserted into the surface part of the sea bottom by the self-weight of the corer 20 for collecting a surface part of marine deposits.

Further, when the corer 20 for collecting a surface part of marine deposits is safely seated at the sea bottom, a rope 31 connected and wound on the piston corer 10 for collecting a deep part of marine deposits is untied while a rope 32 connecting the trigger body 30 to the corer 20 for collecting a surface part of marine deposits is loose, such that the corer for collecting a deep part of marine deposits is dug and stuck in the deep part of the sea bottom while rapidly falling due to the free fall.

As described above, the piston body 1 moves upwardly while the piston corer 10 for collecting a deep part of marine deposits reaches the deep part and thus, the marine deposits are inserted into the external body 11 to be collected.

DETAILED DESCRIPTION OF MAIN ELEMENTS

10. PISTON CORER FOR COLLECTING DEEP PART OF MARINE DEPOSITS
11. EXTERNAL BODY
12. PISTON BODY
20. CORER FOR COLLECTING SURFACE PART OF MARINE DEPOSITS
21. DEPOSITS INSERTING PIPE
22. FRAME
23. UPPER COVER
23A. PACKING
24. LOWER COVER
24A. PACKING
25. COVER DRIVING UNIT
25A. RING
25B. UPPER MOVING BODY
26. UPPER COVER POSITIONAL CONTROLLING UNIT
26A. BOLT
27. LOWER COVER POSITIONAL CONTROLLING UNIT
27A. BOLT
30. TRIGGER BODY
31. ROPE
32. ROPE

The invention claimed is:

1. An apparatus for collecting marine deposits, comprising:

a piston corer (10) for collecting a deep part of marine deposits, the piston corer having an external body (11) stuck in the deep part of a sea bottom while serving as a cylinder body and having a piston body (12) positioned in the external body (11) to move up and down and serving as a piston;

a corer (20) for collecting a surface part of marine deposits, the corer including a deposits inserting pipe (21) in a pipe shape stuck in the surface part of the sea bottom and extending downwardly from a frame (22), the corer further including an upper cover (23) and a lower cover (24) blocking upper and lower portions of the deposits inserting pipe (21) when the deposits inserting pipe (21) is stuck in the sea bottom and in contact with the sea bottom before the piston corer (10) while having a weight guiding the falling of the piston corer (10); and a trigger body (30) connecting the corer (20) and the piston corer (10) to each other while being maintained at a laterally set interval and when the corer (20) is safely seated at the sea bottom, free-falling the piston corer (10) to be stuck in the deep part of the sea bottom while a rope (32) connected to the piston corer (10) is instantly untied.

2. The apparatus for collecting marine deposits of claim 1, wherein the corer (20) is provided with a plurality of deposits inserting pipes (21).

3. The apparatus for collecting marine deposits of claim 1, wherein the corer (20) is provided with a cover driving unit (25) controlling the driving of an upper cover (23) and a lower cover (24) so that the upper cover (23) blocks the upper portion of the deposits inserting pipe (21) in the state in which the upper portion of the deposits inserting pipe (21) is filled with sea water.

4. The apparatus for collecting marine deposits of claim 3, wherein the cover driving unit (25) includes:

a rotatable ring (25*a*) gripping the upper cover (23) so that the upper cover (23) opens the upper portion of the deposits inserting pipe (21); and an upper moving body (25*b*) rotating the ring (25*a*) while moving upwardly when contacting the sea bottom in order to remove a force gripping the upper cover (23).

5. The apparatus for collecting marine deposits of claim 4, wherein the ring (25*a*) grips the lower cover (24) so that the lower portion of the deposits inserting pipe (21) is in the opened state and does not grip the lower cover (24) when the ring (25*a*) is rotated by the upper moving body (25*b*).

6. The apparatus for collecting marine deposits of claim 4, further comprising an upper cover positional controlling unit (26) controlling a distance from a fixed portion of the upper cover (23) to the lower end portion of the upper cover (23), wherein the upper cover (23) is provided with a packing (23*a*) installed at a portion closely attached to the deposits inserting pipe (21) so as to be blocked.

7. The apparatus for collecting marine deposits of claim 4, further comprising a lower cover positional controlling unit (27) controlling a distance from a fixed portion of the lower cover (24) to the lower end portion of the lower cover (24), wherein the lower cover (24) is provided with a packing (24*a*) installed at a portion closely attached to the deposits inserting pipe (21).

* * * * *

UNITED STATES PATENT AND TRADEMARK OFFICE

CERTIFICATE OF CORRECTION

PATENT NO. : 8,191,436 B2
APPLICATION NO. : 12/976938
DATED : June 5, 2012
INVENTOR(S) : Jong Hwa Chun et al.

It is certified that error appears in the above-identified patent and that said Letters Patent is hereby corrected as shown below:

Title Page, Column 1, Item (73) Assignee, Line 2, delete "Resouces" and insert -- Resources --

Column 10, Line 12, Claim 6, after "(21)" delete "so as to be blocked"

Signed and Sealed this
Twenty-fifth Day of September, 2012

David J. Kappos

David J. Kappos
*Director of the United States Patent and Trademark Office*